US012759771B2

(12) United States Patent
Lane

(10) Patent No.: US 12,759,771 B2
(45) Date of Patent: Oct. 13, 2026

(54) LID ASSEMBLY WITH A SLIDER FOR BEVERAGE CONTAINER

(71) Applicant: Thermos L.L.C., Schaumburg, IL (US)

(72) Inventor: Marvin Lane, Brandon, MS (US)

(73) Assignee: Thermos L.L.C., Schaumburg, IL (US)

( * ) Notice: Subject to any disclaimer, the term of this patent is extended or adjusted under 35 U.S.C. 154(b) by 151 days.

(21) Appl. No.: 18/435,196

(22) Filed: Feb. 7, 2024

(65) Prior Publication Data

US 2024/0262581 A1 Aug. 8, 2024

Related U.S. Application Data

(60) Provisional application No. 63/483,868, filed on Feb. 8, 2023.

(51) Int. Cl.
*B65D 47/28* (2006.01)
*B65D 43/02* (2006.01)

(52) U.S. Cl.
CPC ..... *B65D 47/286* (2013.01); *B65D 43/0229* (2013.01); *B65D 2543/005* (2013.01)

(58) Field of Classification Search
CPC ... B65D 47/286; B65D 47/28; A47G 19/2272
See application file for complete search history.

(56) References Cited

U.S. PATENT DOCUMENTS

| | | | | |
|---|---|---|---|---|
| 2016/0270572 | A1 | 9/2016 | Karussi et al. | |
| 2017/0066573 | A1 | 3/2017 | Karussi et al. | |
| 2018/0014671 | A1* | 1/2018 | Karussi | B65D 43/12 |
| 2020/0331671 | A1 | 10/2020 | Seiders et al. | |
| 2022/0112011 | A1 | 4/2022 | McNamara et al. | |
| 2023/0159235 | A1* | 5/2023 | Gillespie | B65D 47/286 220/254.1 |

OTHER PUBLICATIONS

Search Report and Written Opinion for International Patent Application No. PCT/US/2024/014773, 11 pages, May 24, 2024.

* cited by examiner

*Primary Examiner* — Jeffrey R Allen
(74) *Attorney, Agent, or Firm* — Polsinelli PC

(57) ABSTRACT

A beverage container system is described. The beverage container system includes a lid assembly with a slider to selectively close a beverage container. The slider is biased to remain in closed and open positions.

20 Claims, 8 Drawing Sheets

LID ASSEMBLY WITH A SLIDER FOR BEVERAGE CONTAINER

The present application claims priority to U.S. Provisional Patent Application No. 63/483,868 filed Feb. 8, 2023, which is incorporated by reference in its entirety.

FIELD OF INVENTION

The present invention relates to a lid assembly with a slider for a beverage container.

BACKGROUND

Certain beverage containers are known to use lids with closing features or structures to prevent or reduce spillage or leakage of fluids contained in the beverage containers. Such conventional closing features may leak or not provide positive closure. Such conventional closures may not provide an indication to the user that the closure has been secured.

SUMMARY

Certain aspects of a lid assembly with a slider for a beverage container are shown and described. In one aspect, a lid assembly with a slider is described. The lid assembly includes a lid that is configured to engage or connect to an upper portion or neck region of a beverage container. A slider is configured to slideably engage to the lid and move relative to the lid.

The lid includes one or more openings or fluid passages. The slider moves to open and/or cover the openings or fluid passages. The openings or fluid passages are configured to fluidly connect to an interior volume of the beverage container. The user may drink directly from the lid by moving the slider to an open position.

The sliding engagement between the slider and the lid indicates to the user that the slider is in an open, closed, or intermediate position relative to the lid. The slider is harder to move in the intermediate position, which is in between the open and closed positions. This assists in holding the slider in the open and closed positions to help reduce leaks or inadvertent closure of the slider. This also provides a tactile notification to the user of the position of the slider.

In one aspect, the lid includes mating surfaces to hold the slider to the lid in the open and closed positions. The mating surfaces may assist in biasing or compressing a seal of the slider to a surface of the lid.

In other aspects, a lid assembly with a slider for a beverage container is described. The lid assembly includes a lid. The lid is configured to connect or engage to a beverage container. The lid has a central wall. The central wall has a first opening for fluid passage. The lid includes a slider. The slider is configured to engage with the lid. The slider is configured to move relative to the lid to cover and uncover the first opening. The slider includes a connection member. The connection member passes through a second opening in the central wall. The connection member is configured to slide against a lower surface of the central wall.

In other aspects, a lid assembly with a slider for a beverage container is described. The lid assembly includes a lid. The lid is configured to connect or engage to a beverage container. The lid includes a central wall. The central wall includes an opening for fluid passage. The central wall includes a support member. The lid assembly includes a slider. The slider is configured to engage with the lid by a connection member. The connection member is configured to bias or slide against the support member. The slider is configured to move relative to the lid to a closed position in which the slider covers the opening and to an open position in which the slider is moved away from the opening. In the closed position, the slider is biased to remain in the closed position. In the open position, the slider is biased to remain in the open position.

In other aspects, a lid assembly with a slider for a beverage container is described. The lid assembly includes a lid. The lid is configured to connect or engage to a beverage container. The lid includes a central wall. The central wall includes a fluid opening for fluid passage. A slider is configured to engage with the lid. The slider is configured to move relative to the lid to cover and uncover the fluid opening. The slider includes a first connection member and a second connection member. The first connection member passes through a first lateral opening in the central wall. The second connection member passes through a second lateral opening in the central wall. A lower surface of the central wall includes a first ridged surface along a lateral edge of the first lateral opening. The lower surface of the central wall includes a second ridged surface along a lateral edge of the second lateral opening. An upper surface of the first connection member is configured to bias or slide against the first ridged surface. An upper surface of the second connection member is configured to bias or slide against the second ridged surface.

In other aspects, a beverage container system including any of the lid assemblies of the present disclosure and a beverage container is described.

DETAILED DESCRIPTION OF INVENTION

Figure 1:
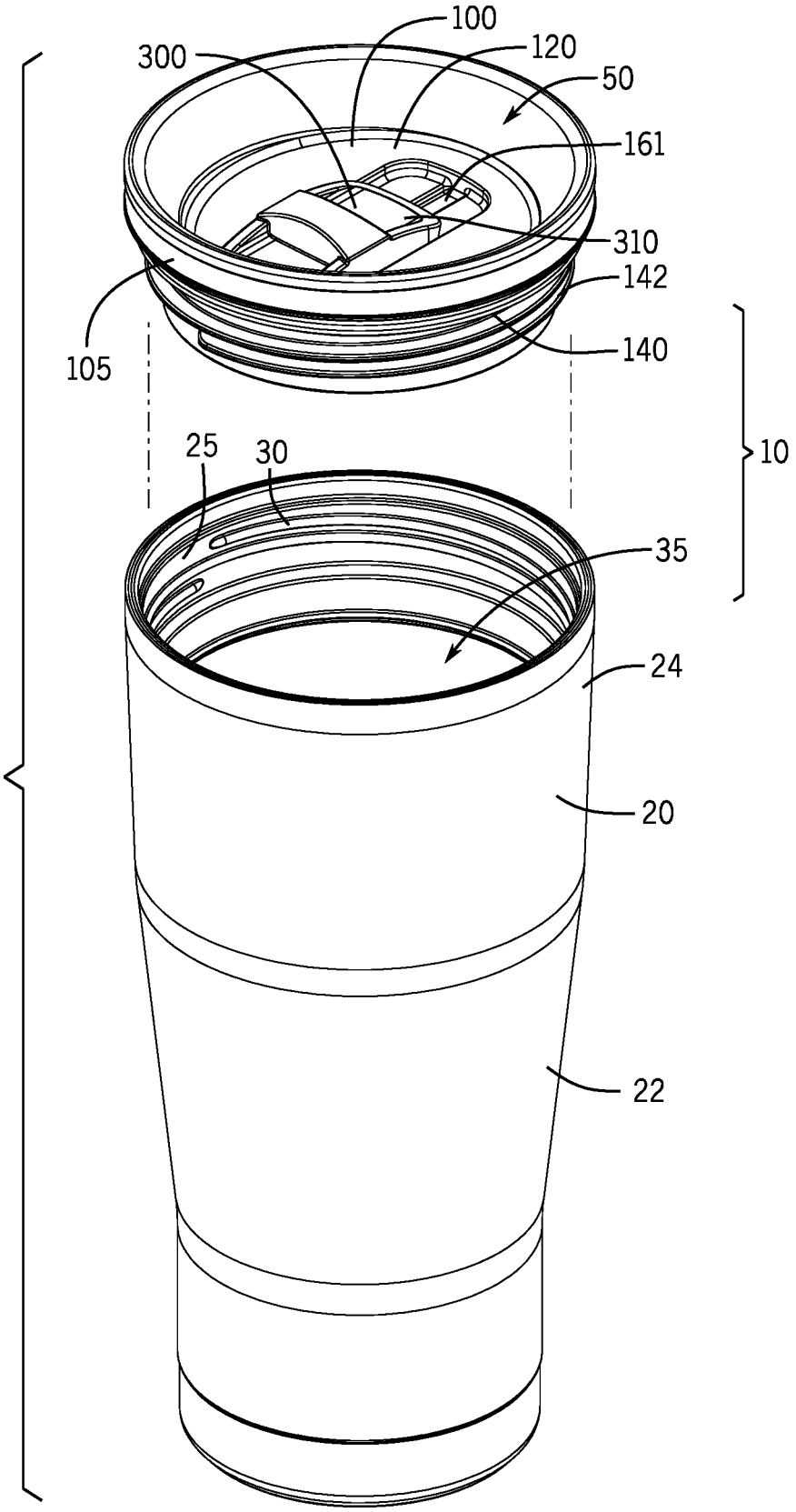
FIG. 1 is a perspective view of a lid assembly with a slider and a bottle.
Figure 2:
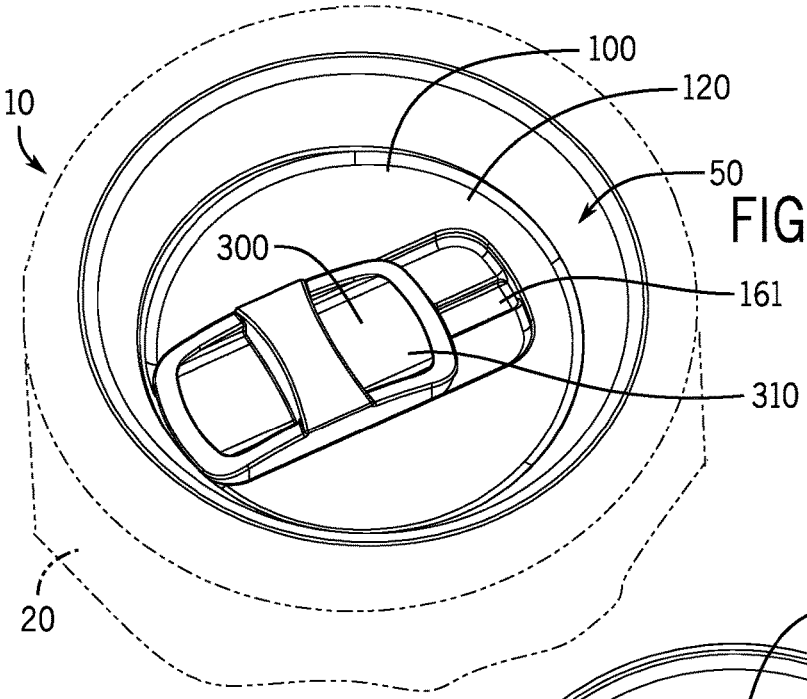
FIG. 2 is a perspective view of the lid assembly with the slider in the closed position.
Figure 3:
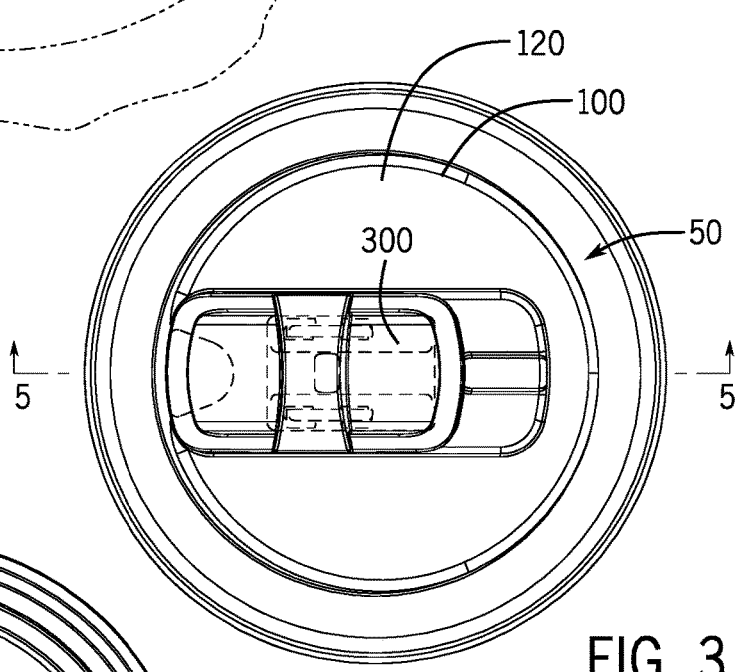
FIG. 3 is an upper view of the lid assembly with the slider in the closed position.
Figure 4:
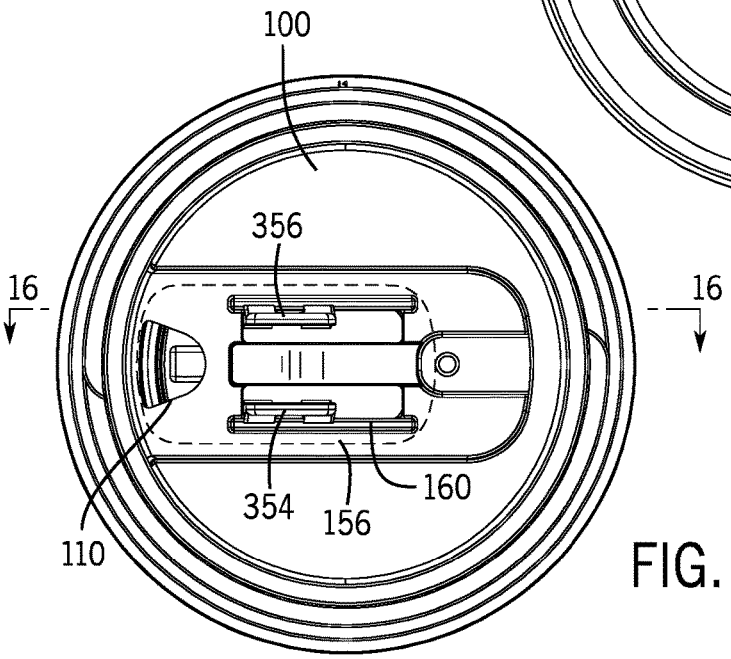
FIG. 4 is a lower view of the lid assembly with the slider in the closed position.

For purposes of this application, any terms that describe relative position (e.g., "upper", "middle" "lower", "outer", "inner", "above", "below", "bottom", "top", etc.) refer to an aspect of the invention as illustrated, but those terms do not limit the orientation in which the embodiments can be used.

A beverage container system 10 will now be described with reference to FIGS. 1-19. The beverage container system 10 includes a container 20 to hold a beverage and a lid assembly with a slider 50 to selectively close the beverage container 20. The lid assembly with a slider 50 may engage with the beverage container 20 to form the beverage container system 10. The lid assembly with a slider 50 controls a flow of a drinking fluid from the beverage container 20.

The lid assembly with a slider 50 includes a lid 100 and a slider 300. The lid 100 includes one or more openings 110 to provide for fluid passage from the container 20 and through the lid 100. The openings 110 may include a circular, semi-circular, ovular, triangular shape, or other shape to accommodate straws of varying widths. The slider 300 connects or engages to the lid 100 to mostly prevent or reduce leakage of fluid from the beverage container system 10. The connection or engagement of the slider 300 to the lid 100 on the beverage container 20 generally seals the liquid in the beverage container 20. When the slider 300 is fully connected or engaged to the lid 100, the beverage container system 10 is generally leak resistant.

The beverage container system 10 generally includes an open position or configuration for drinking and a closed position or configuration for storage. In the open configuration, the slider 300 has been moved away from the one or more openings 110 such that the one or more openings 110 are not covered by the slider 300. In the closed configuration, the slider 300 is positioned over or covers the one or more openings 110, and the slider 300 may seal against the lid 100.

The lid 100 will now be described:

The lid 100 includes the one or more openings 110 to provide for fluid passage from the beverage container 20. The slider 300 removably engages or connects to the lid 100 over the one or more openings 110. The lid 100 may include any number of openings 110 or other fluid passages. The slider 300 moves laterally on an upper portion of the lid 100.

In this aspect, the lid 100 includes an inner sidewall 130 and an outer sidewall 140. In this aspect, the inner sidewall 130 forms a generally circular inner diameter. The outer sidewall 140 includes exterior threads 142 that threadably engage with interior threads 30 of the beverage container 20. The exterior threads 142 and the interior threads 30 may include a helical arrangement, a linear arrangement or other insert and rotate locking or twist to lock arrangements.

The inner sidewall 130 further transitions into a drinking rim 132. The inner sidewall 130 of the lid 100 transitions into a central wall 120. The central wall 120 is configured to removably receive the slider 300. In this aspect, the central wall 120 extends from the inner sidewall 130. The central wall 120 includes the one or more openings 110. The central wall 120 may extend from one side of the inner sidewall 130 to the other side of the inner sidewall 130.

The lid 100 may include a number of different versions, configurations or varieties, depending on drinking style or preference of the user, which may all operate with the slider 300 and the same or different beverage containers 20. The lid 100 may include one or more openings 110 with different sized, shapes, etc. to accommodate hot beverages, cold beverages, a straw, etc. The lid 100 may optionally include a vent to release pressure from inside of the beverage container 20.

The one or more openings 110 in the lid 100 may have a semi-circular, ovular, elliptical, teardrop, geometric, organic, or other shape. Also, only a single opening 110 may be present in the lid 100. The one or more openings 110 provide fluid passage. As used herein, the term "first opening" may refer to the one or more openings 110.

As described below, the lid 100 and the slider 300 removably connect or engage with each other. In this aspect, the lid 100 removably connects or engages to the beverage container 20 to hold the lid assembly 50 to the beverage container 20. In order to fill the container 20 with a beverage, the lid 100 may be unscrewed from the beverage container 20. In other aspects, the beverage container 20 may be filled by directing water through the one or more openings 110 in the lid 100.

In this aspect, the lid 100 threadably engages to the beverage container 20. With reference to FIG. 1, the walls 22 of the upper portion or neck region 24 of the beverage container 20 include an inner surface 25 having the interior threads 30. The interior threads 30 of the beverage container 20 receive the exterior threads 142 of the lid 100 to engage the lid 100 to the beverage container 20. The beverage container 20 includes walls 22 defining an interior volume 35 to hold a beverage. The walls 22 of an upper portion or neck region 24 of the beverage container 20 include the inner surface 25 having the interior threads 30.

Figure 15:
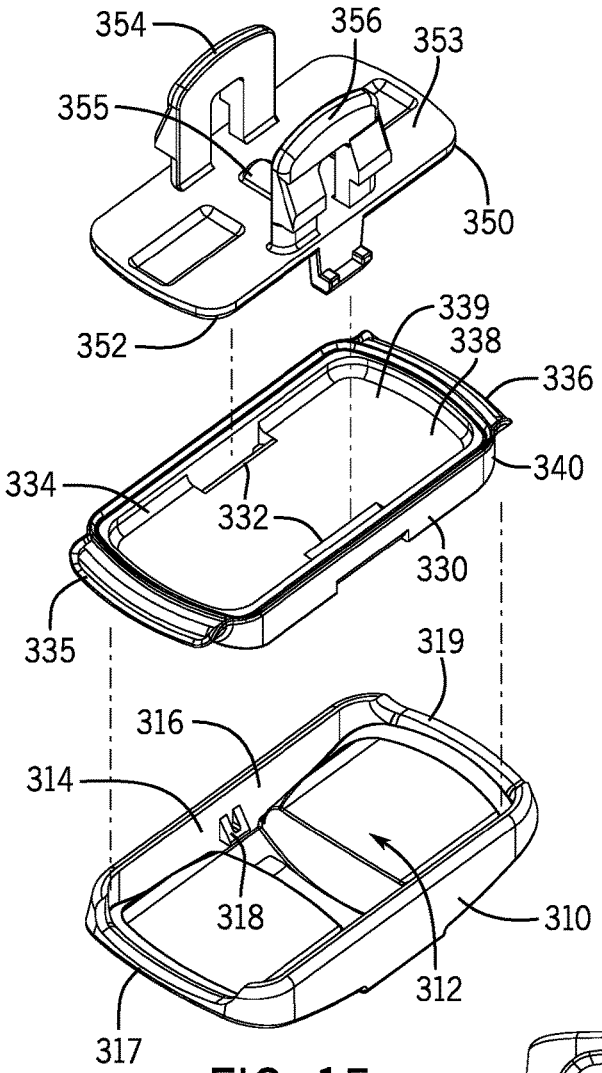
FIG. 15 is an exploded view of the slider.
Figure 14:
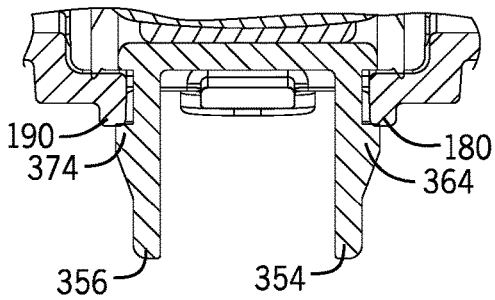
FIG. 14 is a sectional view of the slider engaged to the lid.
Figure 16:
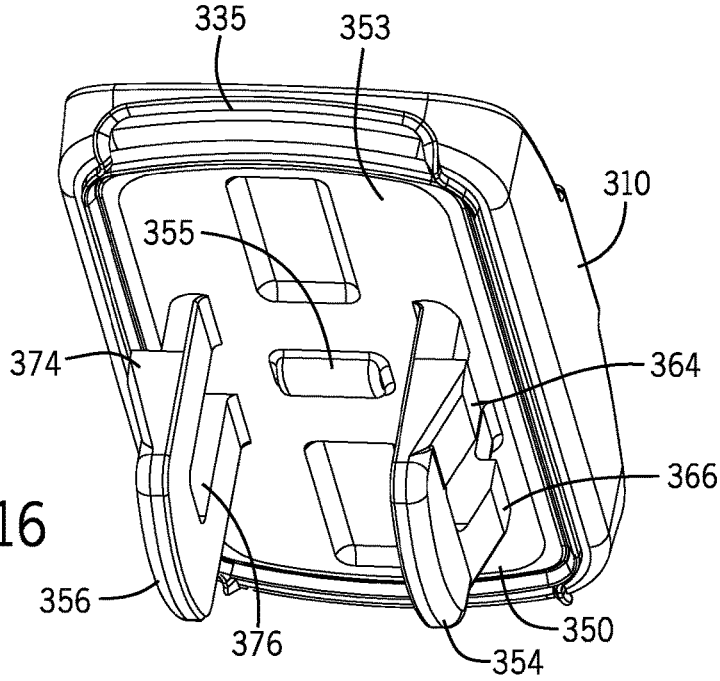
FIG. 16 is a lower perspective view of the slider.

The slider 300 will now be described:

With respect to FIGS. 14-16, in this aspect, the slider 300 includes an upper housing 310, a gasket 330, and a connection member 350. In other aspects, the slider 300 may combine these three components into a single member or a two-piece member. In other aspects, one of these components may be omitted. For example, the upper housing 310 or the connection member 350 may include an integral gasket feature. For example, the upper housing 310 and the connection member 350 may be formed as integral structure. In this aspect, the connection member 350 and the lid 100 include mating surfaces to tighten the gasket 330 to the lid 100 in the open and closed positions while allowing the slider 300 to move between the open and closed positions.

The upper housing 310 includes an open lower region 312 that is sized and configured to receive the gasket 330. The upper housing 310 may nest over the gasket 330. In this aspect, an inner surface 314 of sidewalls 316 of the upper housing 310 include catches or frictional gripping surfaces 318 that engage with complementary catch surfaces 332 in a sidewall 334 of the gasket 330.

The gasket 330 includes the sidewall 334 that extends downward from a central portion 338 of the gasket 330. A distal portion of the sidewall 334 include a lower sealing surface 340 that seals against a generally flat upper surface 152 of a recess 150 in the central wall 120. The gasket 330 may include a seal, compressible member, or other elastomeric member that mostly prevents or reduces leakage. As the slider 300 is fully moved to the closed position, the gasket 330 is compressed against the generally flat upper surface 152 of the recess 150. The gasket 330 includes a lower side 339, which covers the one or more openings 110 when the slider 300 is engaged to the lid 100. The lower sealing surface 340 of the gasket 330 may seal against the generally flat upper surface 152 of the recess 150 of the lid 100. A front tab portion 335 may extend from a front portion of the gasket 330, and a rear tab portion 336 may extend from a rear portion of the gasket 330. The front tab portion 335 and the rear tab portion 336 improve the sealing engagement of the gasket 330 to the generally flat upper surface 152. The front tab portion 335 may extend over and seal the one or more openings 110. The front tab portion 335 may extend to or approach the inner sidewall 130 in the closed position of the slider 300. The upper housing 310 may include a front recess 317 and a rear recess 319 to accommodate the front tab portion 335 and the rear tab portion 336, respectively.

The connection member 350 includes an upper portion 352 that slides over the generally flat upper surface 152 of the recess 150. In this aspect, the connection member 350 nests into or against the lower side 339 of the gasket 330. In this aspect, a lower surface 353 of the connection member 350 includes a protruding portion 355 that biases or slides against the support member 162. The protruding portion 355 may include a bump or raised portion in the connection member 350.

The connection member 350 further includes a first connection member 354 and second connection member 356, which pass through an opening 160 in the central wall 120. In this aspect, the opening 160 includes a lateral opening 176 and a lateral opening 178. The first connection member 354 and the second connection member 356 extend downward from the connection member 350. When the slider 300 is engaged to the lid 100, in this aspect, the first connection member 354 passes through the lateral opening 176, and the second connection member 356 passes through the lateral opening 178. The lateral openings 176 and 178 may include a linear shape orientated parallel to a direction of movement of the slider 300. In this aspect, the first connection member 354 includes a first forward upper surface 364 and a first rear upward surface 366, and the second connection member 356 includes a second forward upward surface 374 and second rear upward surface 376. In other aspects, the lateral opening 176 and the lateral opening 178 may be part of a same opening.

The engagement of the slider 300 to the lid 100 will now be described:

The central wall 120 includes the recess 150. The recess 150 includes the generally flat upper surface 152 that forms a sealing surface for the gasket 330. In this aspect, the recess 150 is defined by a recess wall 155. When the slider 300 is engaged to the lid 100, the slider 300 slides in the recess 150 and covers the one or more openings 110 in the lid 100.

In this aspect, the recess 150 further includes the opening 160. The support member 162 spans the opening 160. The support member 162 includes a first lateral portion 164, a raised portion 166, and a second lateral portion 168. The raised portion 166 extends upward from the support member 162. The raised portion 166 may be positioned between the first lateral portion 164 and the second lateral portion 168. The first lateral portion 164 and the second lateral portion 168 may be generally flat.

In this aspect, the opening 160 is divided into the lateral openings 176 and 178, which are formed on opposite sides of the support member 162. The recess 150 further includes a depression 161. The depression 161 assists in providing venting to the gasket 330 such that the slider 300 may be easily moved from the closed position. As used herein, the term "second opening" may refer to the opening 160 and/or the lateral openings 176 and 178.

A lower surface 156 of the recess 150 includes a first ridged surface 180 and a second ridged surface 190 along lateral edges of the opening 160. The first ridged surface 180 includes a first lower surface 181. Similarly, the second ridged surface 190 includes a second lower surface 191. In this aspect, the first ridged surface 180 is generally parallel to the second ridged surface 190.

Figure 5:
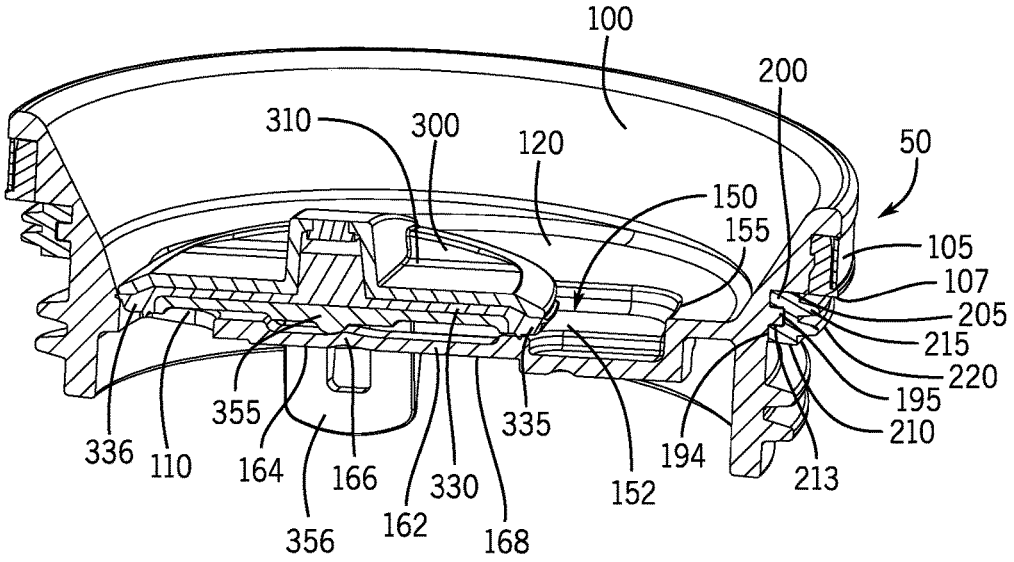
FIG. 5 is a sectional view of the lid assembly with the slider in the closed position.
Figure 6:
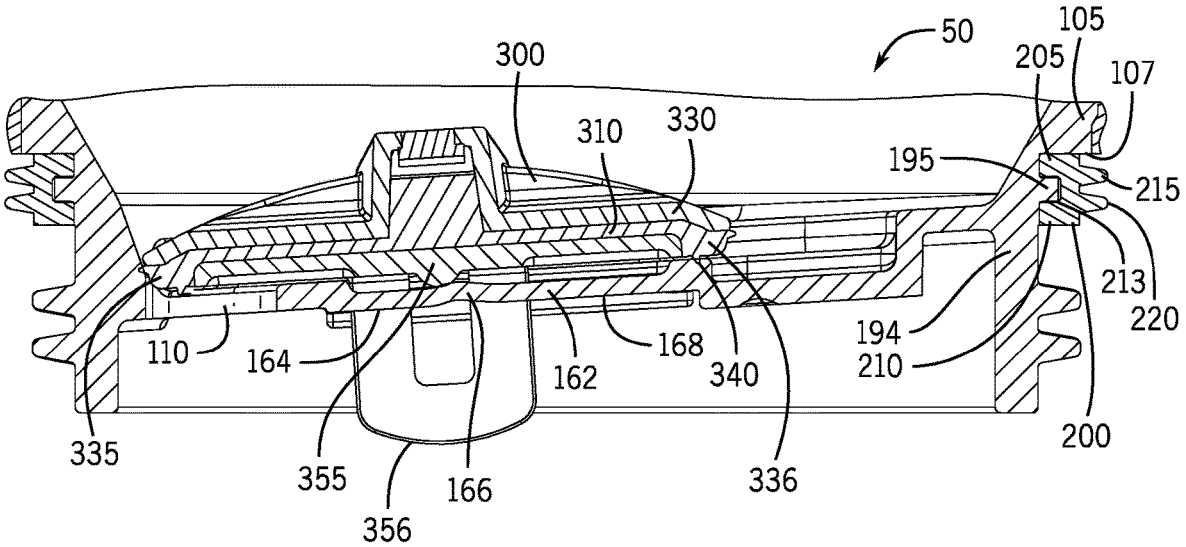
FIG. 6 is a sectional view of the lid assembly with the slider in the closed position.
Figure 7:
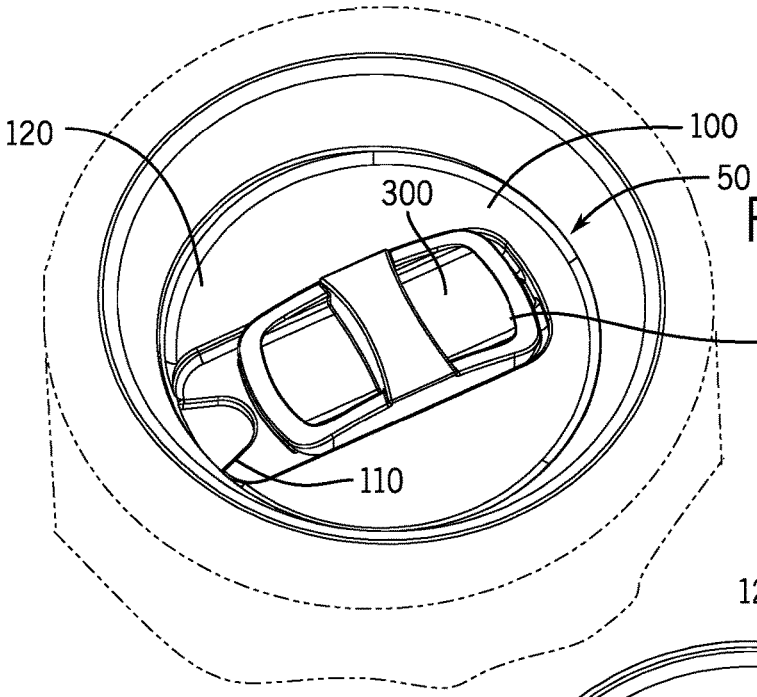
FIG. 7 is a perspective view of the lid assembly with a slider in the open position.
Figure 8:
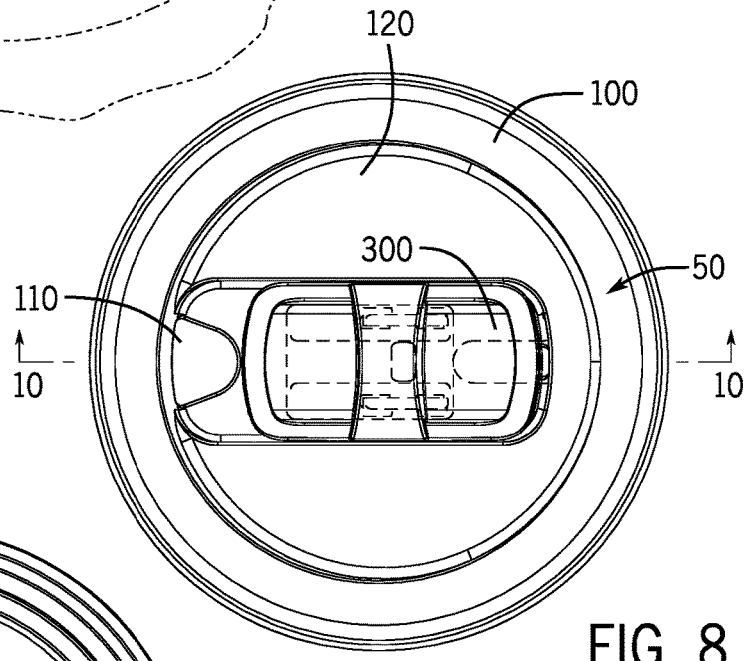
FIG. 8 is an upper view of the lid assembly with the slider in the open position.
Figure 9:
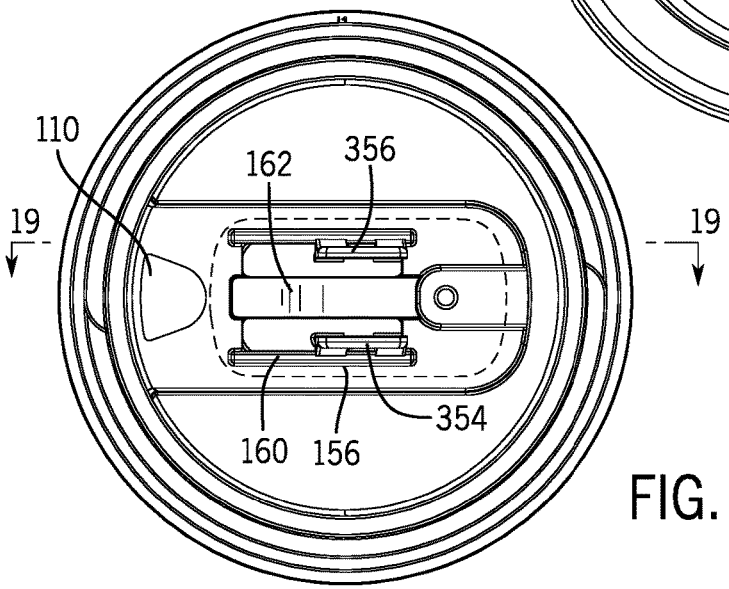
FIG. 9 is a lower view of the lid assembly with the slider in the open position.
Figure 17:
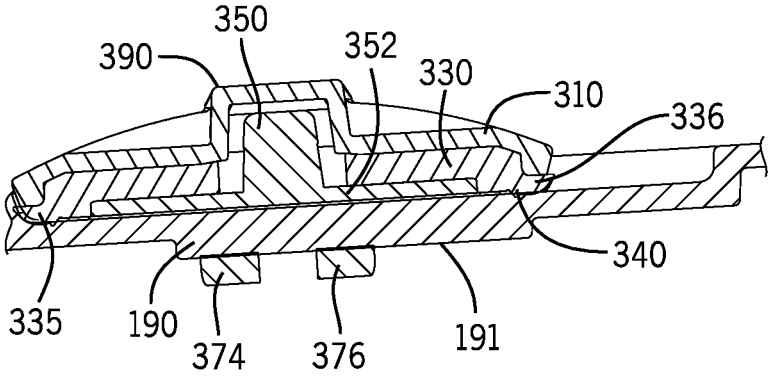
FIG. 17 is a sectional view of the slider engaged to the lid in the closed position.

With respect to FIGS. 5, 6, and 17, the closed position of the slider 300 relative to the lid 100 is shown. The protruding portion 355 is against the first lateral portion 164, and the protruding portion 355 is to a left side or first side of the raised portion 166. This holds or biases the slider 300 to remain in the closed position. In order to move to the open position from the closed position, sufficient force is applied to move the protruding portion 355 over the raised portion 166 and past an intermediate position. In the aspect of FIGS. 5, 6, and 17, the slider 300 is moved to the right to get to the open position.

As the slider 300 is moved relative to the lid 100, the first forward upper surface 364 biases or slides against the first lower surface 181 of the first ridged surface 180, and the second forward upward surface 374 biases or slide against the second lower surface 191 of the second ridged surface 190. The first rear upward surface 366 biases or slides against the first lower surface 181 of the first ridged surface 180, and the second rear upward surface 376 biases against the second lower surface 191 of the second ridged surface 190. This engagement compresses and holds the gasket 330 against the generally flat upper surface 152 of the recess 150.

Figure 18:
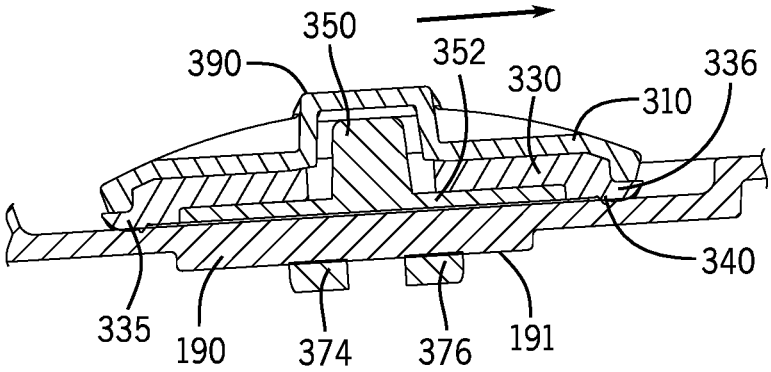
FIG. 18 is a sectional view of the slider engaged to the lid in the intermediate position.

In FIG. 18, the intermediate position of the slider 300 is shown. In the intermediate position, the protruding portion 355 may be over or against the raised portion 166. In order to move between the open and closed positions, the protruding portion 355 is urged over or past the raised portion 166, which biases the slider 300 to remain in the closed or open positions.

Figure 10:
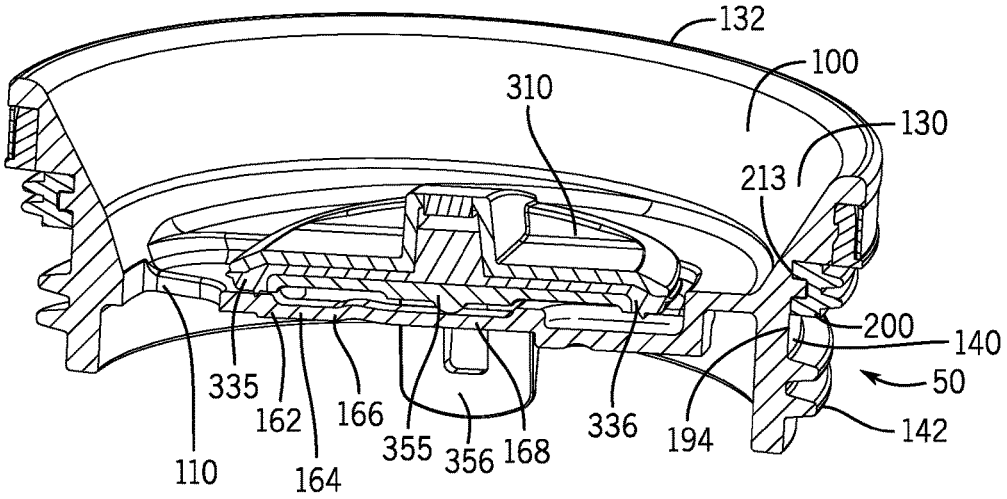
FIG. 10 is a sectional view of the lid assembly with the slider in the open position.
Figure 11:
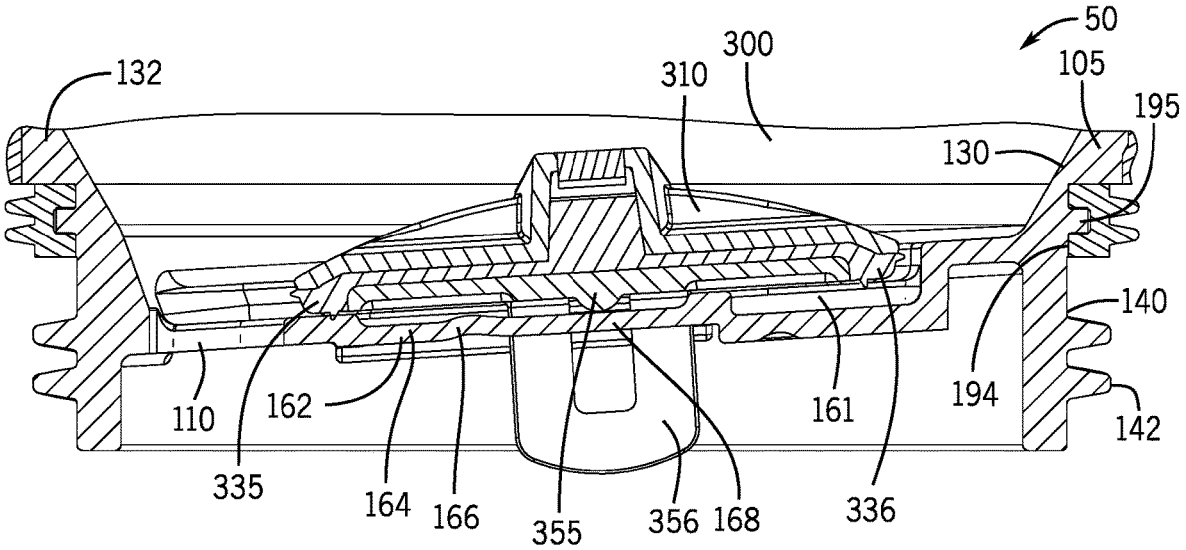
FIG. 11 is a sectional view of the lid assembly with the slider in the open position.
Figure 12:
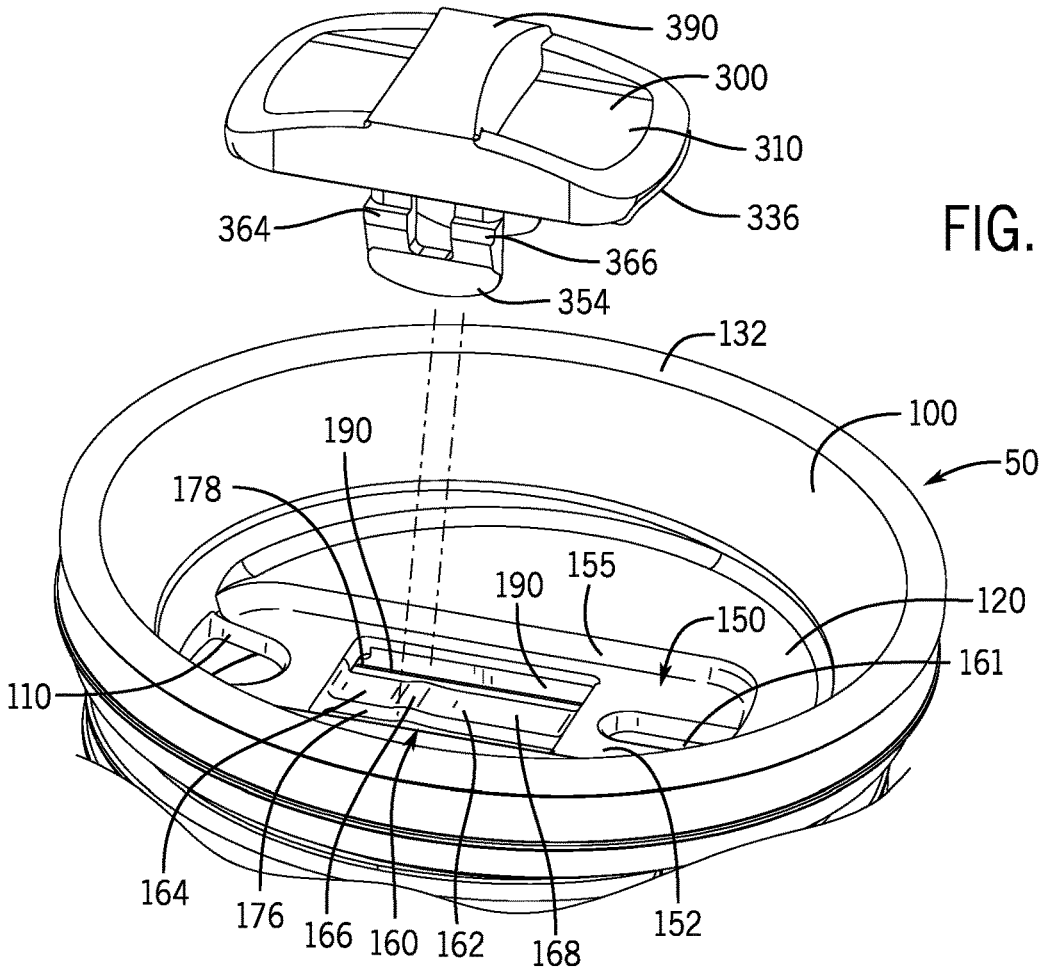
FIG. 12 is an upper view of the slider prior to engagement of the lid.
Figure 13:
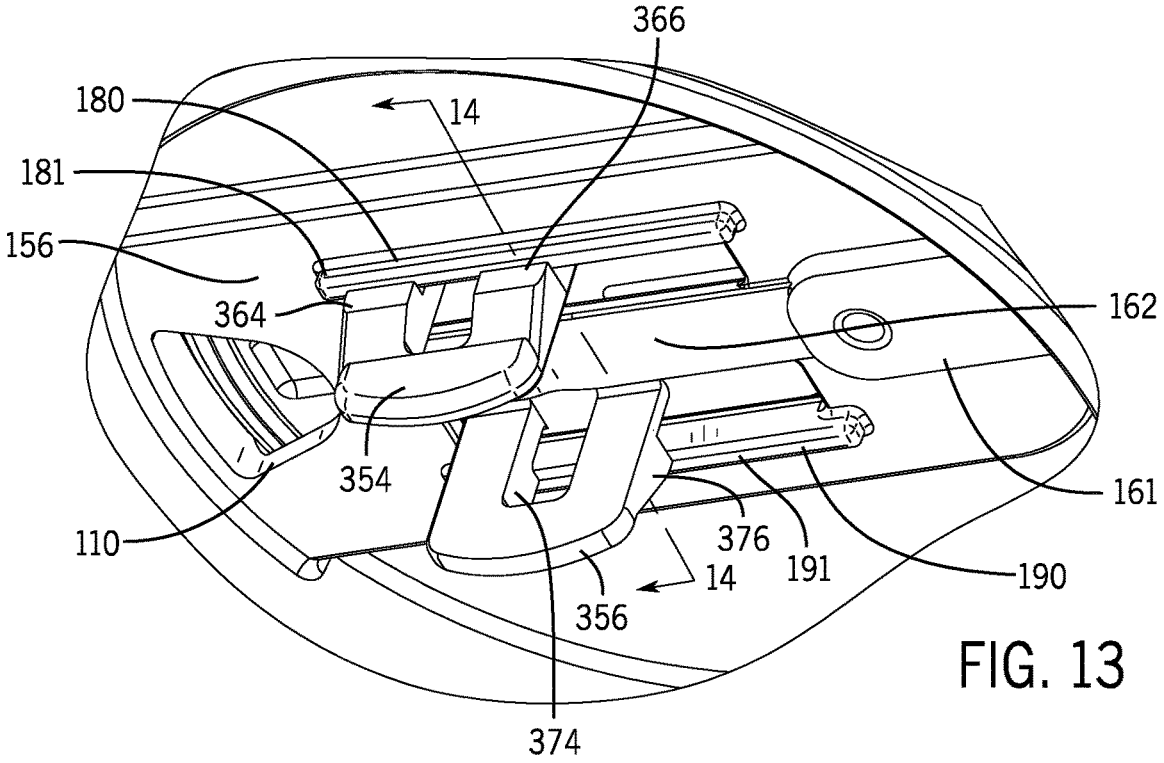
FIG. 13 is a lower view of the slider engaged to the lid.
Figure 19:
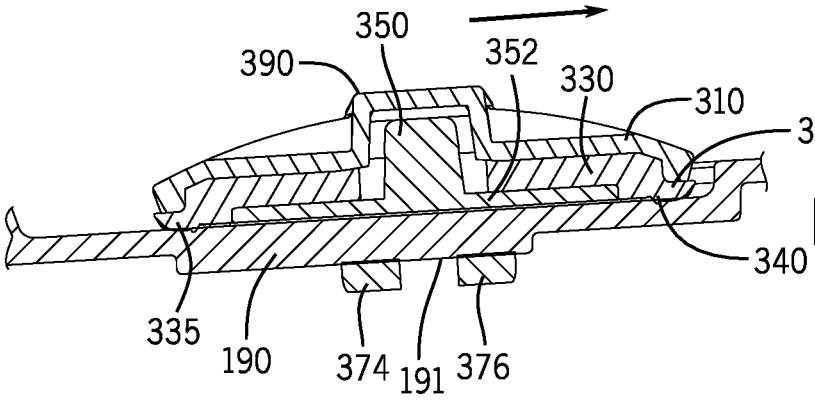
FIG. 19 is a sectional view of the slider engaged to the lid in the open position.

With respect to FIGS. 10, 11, and 19, the open position of the slider 300 relative to the lid 100 is shown. The protruding portion 355 is against the second lateral portion 168, and the protruding portion 355 is to a right side or a second side of the raised portion 166. This holds or biases the slider 300 to remain in the open position. In order to move to the closed position from the open position, sufficient force is applied to move the protruding portion 355 over the raised portion 166 and past the intermediate position. In the aspect of FIGS. 10, 11, and 19, the slider 300 is moved to the left to get to the closed position.

The slider 300 may be removed from the lid 100 for cleaning. The user may squeeze the first connection member 354 and the second connection member 356 together to free the surfaces 364, 366, 374, and 376 from the first ridged surface 180 and the second ridged surface 190. Then, the first connection member 354 and the second connection member 356 may be removed from the lateral opening 176 and lateral opening 178. The first connection member 354 and the second connection member 356 may be made from a resiliently flexible material that may bent inward for removal and then naturally flexes back to a normal position.

In this aspect, the upper housing 310 of the slider 300 includes a knob 390 extending from an upper surface 320 of the upper housing 310 of the slider 300. In other aspects, the knob 390 may be omitted. The upper surface 320 may include a textured surface to provide a frictional gripping structure for the user to move the slider 300.

One benefit of certain aspects of the lid assembly 50 is that the sliding engagement between the slider 300 and the lid 100 may indicate to the user that the slider 300 is in the open, closed, or intermediate positions relative to the lid 100. The slider 300 is harder to move past the intermediate position between the open and closed positions, which assists in holding the slider 300 in the open and closed positions. This helps to maintain the slider 300 in the open position such that the slider 300 does not inadvertently close while the user drinking. Further, this helps to maintain the slider 300 in the closed position such that the slider 300 does not inadvertently open during storage and allow a leak.

In this aspect, a lid gasket 200 is engaged to an upper outer diameter 194 of the lid 100. In this aspect, the lid gasket 200 is positioned just below a rim 105 of the lid 100. In this aspect, a flange 195 extends from the upper outer diameter 194 of the lid 100 and assists in holding the lid gasket 200 in position on the lid 100. In this aspect, the lid gasket 200 includes an inner extending upper portion 205 and an inner extending lower portion 210 that fit around the flange 195. The inner extending upper portion 205 may further seal against a lower surface 107 of the rim 105. An annular groove 213 may be formed between the inner extending upper portion 205 and the inner extending lower portion 210 that receives the flange 195.

The lid gasket 200 seals against the beverage container 20 when the lid 100 is threaded to the beverage container 20. The lid gasket 200 may further include outward extending fins 215 and 220, which bend and flex against an inner surface of the beverage container 20 in a sealing engagement. In other aspects, the lid gasket 200 may include a single outward extending fin or additional outward extending fins.

In this aspect, the lid gasket 200 extends outward from the upper outer diameter 194 of the lid 100 a greater distance than the exterior threads 142 of the lid 100. As shown in FIG. 6, the outward extending fins 215 and 220 extend beyond an outer surface of the exterior threads 142 of the beverage container system 10. This provides improved sealing between the lid 100 and the beverage container 20.

The positioning of the lid gasket 200 at the upper outer diameter 194 of the lid 100 near the rim 105 improves an alignment between the lid 100 and the beverage container 20. The positioning of the lid gasket 200 at the upper outer diameter 194 of the lid 100 near the rim 105 may make it easier for the user to properly thread the lid 100 to the interior threads 30 without cross-threading or misalignment. The positioning of the lid gasket 200 at the upper outer diameter 194 of the lid 100 near the rim 105 provides for the lid 100 to compress the lid gasket 200 as the lid 100 and/or its rim 105 bottoms out or seats against the beverage container 20.

The lid gasket 200 is typically formed of flexible or resilient material and may include a larger outer diameter than the exterior threads 142 of the lid 100. With the lid gasket 200 positioned proximate the rim 105, it may be easier for the user to insert a lower portion 109 of the lid 100 into the beverage container 20 and properly align the exterior threads 142 with the interior threads 30 without physical interference from the lid gasket 200. The lower portion 109 of the lid 100 typically includes a smaller outer diameter than the exterior threads 142 of the lid 100 and the lid gasket 200. Further, lower portion 109 is typically made of a more rigid material than the lid gasket 200. With the lid gasket 200 positioned proximate the rim 105, the lid gasket 200 does not usually interfere with the initial engagement or alignment between the lid 100 and the beverage container 20. As the lid 100 is rotated and threadably engaged to the beverage container 20, the lid gasket 200 is ultimately compressed against the inner surface 25 of the beverage container 20 when the lid 100 bottoms out or fully seats against the beverage container 20.

In the aspect of FIGS. 1-19, the interior threads 30 of the beverage container 20 and the exterior threads 142 of the lid 100 include a double threaded engagement to aid in alignment between the lid 100 and the interior threads 30. In other aspects, the lid 100 may engage to the beverage container 20 in single threaded engagement and in other manners than a threaded engagement, including a snap-fit engagement, frictional engagement, bayonet engagement, or other engagements configured to selectively attach the lid 100 to the beverage container 20.

In this aspect, the container 20 has a thermally insulated, double wall construction. In other aspects, the container 20 includes a non-insulated single-layer or multilayer construction or other insulated constructions. The container 20 may be formed from moldable food-grade plastics, thermoplastics, stainless steel, other metals and metal alloys, other plastics, or any combination thereof.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A lid assembly with a slider, comprising:

a lid, the lid is configured to connect or engage to a beverage container; the lid having a central wall, the central wall having a first opening for fluid passage;

a slider, the slider is configured to engage with the lid, and the slider configured to move relative to the lid to cover and uncover the first opening;

the slider comprising a connection member, wherein the connection member is configured to pass through a second opening in the central wall;

a gasket, the gasket including a central portion and a lower side, wherein the connection member nests into or against the lower side of the gasket; and wherein the connection member is configured to slide against a lower surface of the central wall, and the gasket is configured to seal or compress against an upper surface of the central wall.

2. The lid assembly with a slider according to claim 1, wherein the slider is configured to move between a closed position, an intermediate position, and an open position, wherein in the closed position, the slider covers the first opening, and wherein in the open position, the slider does not cover the first opening.

3. The lid assembly with a slider according to claim 1, wherein the lid comprises a support member in the second opening.

4. The lid assembly with a slider according to claim 3, wherein the support member includes a first lateral portion, a raised portion, and a second lateral portion, and the support member spans the second opening.

5. The lid assembly with a slider according to claim 4, wherein the raised portion extends upward from the support member, and the raised portion is positioned between the first lateral portion and the second lateral portion.

6. The lid assembly with a slider according to claim 3, wherein a lower surface of the connection member includes a protruding portion that biases or slides against the support member.

7. The lid assembly with a slider according to claim 3, wherein the support member includes a raised portion, and wherein the connection member includes a protruding portion that biases or slides against the support member.

8. The lid assembly with a slider according to claim 7, wherein the slider is configured to move between a closed position and an open position, and the protruding portion is configured to be urged over or past the raised portion.

9. The lid assembly with a slider according to claim 8, wherein the protruding portion and the raised portion bias the slider to remain in the closed position or the open position.

10. The lid assembly with a slider according to claim 1, wherein a support member spans the second opening, the support member includes a first lateral portion, a raised portion, and a second lateral portion, wherein the connection member includes a protruding portion, wherein the slider is configured to move between a closed position and an open position, wherein in the closed position, the protruding portion is against the first lateral portion and the protruding portion is positioned next to a first side of the raised portion, wherein in the open position, the protruding portion is against the second lateral portion, and the protruding portion is positioned next to a second side of the raised portion.

11. The lid assembly with a slider according to claim 1, wherein the connection member includes a first connection member and a second connection member.

12. The lid assembly with a slider according to claim 11, wherein a lower surface of the lid includes a first ridged surface and a second ridged surface along lateral edges of the second opening.

13. The lid assembly with a slider according to claim 12, wherein an upper surface of the first connection member biases or slides against the first ridged surface; and wherein an upper surface of the second connection member biases or slides against the second ridged surface.

14. The lid assembly with a slider according to claim 12, wherein the first connection member includes a first forward upward surface and a first rear upward surface configured to bias or slide against the first ridged surface, and the second connection member includes a second forward upward surface and second rear upward surface configured to bias or slide against the second ridged surface.

15. The lid assembly with a slider according to claim 11, wherein the first connection member and the second connection member are resiliently flexible to hold the slider to the lid, and wherein the first connection member and the second connection member are configured to flex inward to separate the slider from the lid.

16. A beverage container system, comprising the lid assembly with a slider according to claim 1, and further comprising a beverage container, and the first opening is configured to fluidly connect to an interior volume of the beverage container.

17. The lid assembly with a slider according to claim 1, wherein a distal portion of a sidewall of the gasket includes a lower sealing surface that seals against a generally flat upper surface of a recess of the central wall.

18. A lid assembly with a slider, comprising:

a lid, the lid is configured to connect or engage to a beverage container; the lid having a central wall, the central wall having a first opening for fluid passage;

a slider, the slider is configured to engage with the lid, and the slider configured to move relative to the lid to cover and uncover the first opening;

the slider comprising a connection member, wherein the connection member is configured to pass through a second opening in the central wall;

wherein the connection member is configured to slide against a lower surface of the central wall;

wherein the slider comprises an upper housing, a gasket, and a connection member, wherein the upper housing fits over the gasket; and wherein the connection member nests into or against the lower side of the gasket, and a distal portion of a sidewall of the gasket is configured to seal against the central wall.

19. The lid assembly with a slider according to claim 18, wherein an inner surface of sidewalls of the upper housing include catches or frictional gripping surfaces that engage with complementary catch surfaces in the sidewall of the gasket.

20. A lid assembly with a slider, comprising:

a lid, the lid is configured to connect or engage to a beverage container; the lid comprising a central wall, the central wall having a fluid opening for fluid passage;

a slider, the slider configured to engage with the lid, and the slider configured to move relative to the lid to cover and uncover the fluid opening;

the slider comprising a connection member, the connection member comprising a first connection member and a second connection member, wherein the first connection member passes through a first lateral opening in the central wall; wherein the second connection member passes through a second lateral opening in the central wall;

a gasket configured to compress against an upper surface of the central wall, the gasket comprising a lower side, wherein the connection member nests into or against the lower side of the gasket;

a lower surface of the central wall includes a first ridged surface along a lateral edge of the first lateral opening;

the lower surface of the central wall includes a second ridged surface along a lateral edge of the second lateral opening;

wherein an upper surface of the first connection member is configured to bias or slide against the first ridged surface and compress the gasket against the upper surface of the central wall; and wherein an upper surface of the second connection member is configured to bias or slide against the second ridged surface and compress the gasket against the upper surface of the central wall.

* * * * *